US010835447B2

(12) United States Patent
Chateauvert et al.

(10) Patent No.: US 10,835,447 B2
(45) Date of Patent: Nov. 17, 2020

(54) PERSONAL CARE TOOL FOR COOLING AND TREATING SKIN

(71) Applicant: ELC Management LLC, Melville, NY (US)

(72) Inventors: Matthew Chateauvert, Harrison, NY (US); Heidi Reuter, Old Greenwich, CT (US); Joyce Kassouf, New York, NY (US); David Wilson, Melville, NY (US); Jennifer Palmer Quintano, New York, NY (US)

(73) Assignee: ELC MANAGEMENT LLC, Melville, NY (US)

( * ) Notice: Subject to any disclaimer, the term of this patent is extended or adjusted under 35 U.S.C. 154(b) by 154 days.

(21) Appl. No.: 15/887,581

(22) Filed: Feb. 2, 2018

(65) Prior Publication Data

US 2019/0240108 A1 Aug. 8, 2019

(51) Int. Cl.
*A61H 7/00* (2006.01)

(52) U.S. Cl.
CPC ..... *A61H 7/003* (2013.01); *A61H 2201/0157* (2013.01); *A61H 2201/0214* (2013.01); *A61H 2201/0221* (2013.01); *A61H 2201/1253* (2013.01); *A61H 2201/1604* (2013.01); *A61H 2201/1664* (2013.01); *A61H 2201/1666* (2013.01); *A61H 2201/1692* (2013.01); *A61H 2205/022* (2013.01); *A61H 2205/024* (2013.01)

(58) Field of Classification Search
CPC .... A61H 2201/0157; A61H 2201/0214; A61H 2201/0221; A61H 2201/1253; A61H 2201/1604; A61H 2201/1664; A61H 2201/1666; A61H 2201/1692; A61H 2205/022; A61H 2205/024
See application file for complete search history.

(56) References Cited

U.S. PATENT DOCUMENTS

| | | | | |
|---|---|---|---|---|
| 7,955,016 | B2 * | 6/2011 | Gueret | A45D 34/04 401/123 |
| 9,855,187 | B2 * | 1/2018 | Martin | A63B 21/0085 |
| 10,405,637 | B2 * | 9/2019 | Thorpe | A45D 34/04 |
| 10,473,093 | B2 * | 11/2019 | Kwon | A61F 2/68 |
| 2003/0009116 | A1 * | 1/2003 | Luettgen | A61H 19/34 601/46 |
| 2008/0139981 | A1 * | 6/2008 | Walquist | A61H 7/001 601/134 |
| 2008/0300529 | A1 * | 12/2008 | Reinstein | A61F 7/007 604/20 |
| 2010/0002841 | A1 * | 1/2010 | Jaafar | H01J 35/065 378/122 |
| 2011/0040361 | A1 * | 2/2011 | Levy | A61F 7/00 607/114 |
| 2011/0103879 | A1 * | 5/2011 | Neuner | A45D 34/04 401/203 |

(Continued)

OTHER PUBLICATIONS

Epoxy Technology, "EPO-TEK® H20E Technical Data Sheet", Feb. 2010 (Year: 2010).*

(Continued)

*Primary Examiner* — Tu A Vo
*Assistant Examiner* — Alexander Morales
(74) *Attorney, Agent, or Firm* — Peter Giancana

(57) ABSTRACT

A handheld massage tool that provides a cooling effect, intended to treat and improve the appearance of the skin, especially of the face.

14 Claims, 7 Drawing Sheets

(56) References Cited

U.S. PATENT DOCUMENTS

| | | | | |
|---|---|---|---|---|
| 2012/0209363 | A1* | 8/2012 | Williams, III | A61F 7/02 607/114 |
| 2013/0085422 | A1* | 4/2013 | Gillespie | A45D 34/041 601/154 |
| 2013/0197409 | A1* | 8/2013 | Baxter | A61F 7/10 601/46 |
| 2016/0184173 | A1* | 6/2016 | Chen | A61F 7/007 601/18 |
| 2016/0206470 | A1* | 7/2016 | Vic | A45D 19/0008 |
| 2017/0172837 | A1* | 6/2017 | Yang | A61H 23/0254 |
| 2019/0167915 | A1* | 6/2019 | Gildea | A61F 7/10 |
| 2019/0290531 | A1* | 9/2019 | Bosma | A61F 7/007 |

OTHER PUBLICATIONS

Atlas Steels, "Stainless Steel Grade Datasheets", Aug. 2013 (Year: 2013).*

* cited by examiner

PERSONAL CARE TOOL FOR COOLING AND TREATING SKIN

FIELD OF THE INVENTION

The invention is in the field of personal care tools that provide a cooling effect, and are used to treat puffiness, inflammation and the appearance of the skin.

BACKGROUND OF THE INVENTION

Handheld cooling implements for drawing heat away from the surface of the skin are known. One type of device makes use of a removable reservoir of liquid coolant that acts as a heat sink to draw heat away from a skin-contact surface. The removal of heat from the skin surface provides a cooling effect. In those embodiments that use a reservoir of coolant, the reservoir must be removed from the device, chilled, and reinserted into the device at the time of use. Opportunities to damage or misplace the reservoir of coolant make this type of device less than ideal. A simpler, more reliable device would not use a reservoir of liquid coolant, and would not require a user to disassemble and reassemble the device. Other known devices may use a phase change material, a material that transitions from solid to liquid, as the heat sink to receive heat from the user's skin. However, since the phase change material is initially frozen, the tool incorporating the material is too cold for personal care facial applications.

SUMMARY

A personal care cooling tool (10) according to the present invention provides a cooling sensation. Upon contact with a surface, the tool removes thermal energy from the surface. The tool may be used to treat areas of the face, such as under-eye, forehead, cheeks, and jowls to improve the appearance of the skin by reducing inflammation, puffiness, blood pooling and other undesirable skin imperfections. The tool may also be used to massage other parts of the body to sooth and relax the muscles, and reduce swelling in cutaneous tissues. In a laboratory environment, a personal care tool according to the present may also be used to lower the temperature of solid surfaces and fluid materials without chemically altering or diluting the constituents.

The cooling tool (10) comprises an applicator head (2) that has a relatively higher thermal conductivity, a grasping surface (1) that has a relatively lower thermal conductivity, and a heat absorbing core (3) that has a thermal capacity above a certain minimum value. Preferably, these components are permanently assembled so that from a user perspective, the tool is a one-piece construction, and does not need to be disassembled and reassembled by the user. This is unlike some cooling devices that require have a removable reservoir of coolant. In those embodiments, the reservoir of coolant must be removed from the device, chilled, and reinserted into the device at the time of use. In contrast, the permanent assembly described herein is easier to use, and makes for a very robust hand tool that stands up to consumer usage and environmental factors that could lead to damage and diminished functionality. The tool can also be manufactured at a lower price point.

DETAILED DESCRIPTION

Figure 1:
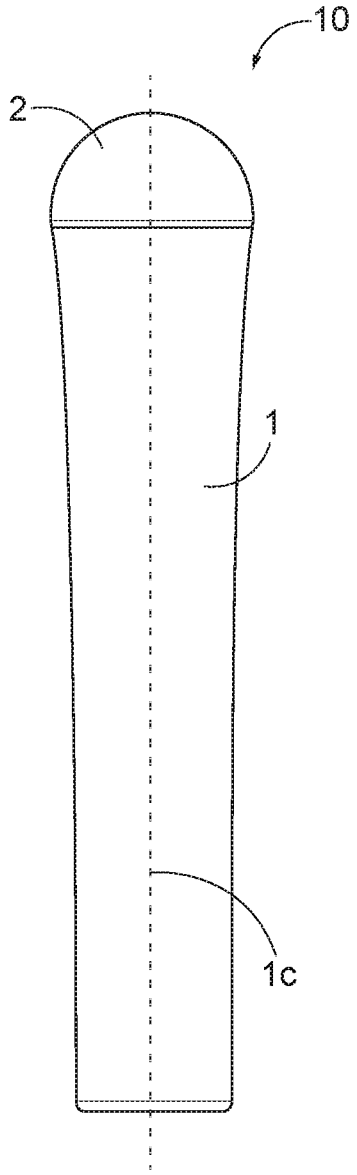
FIG. 1 depicts a personal care tool (10) for cooling and treating skin according to the present invention.
Figure 2:
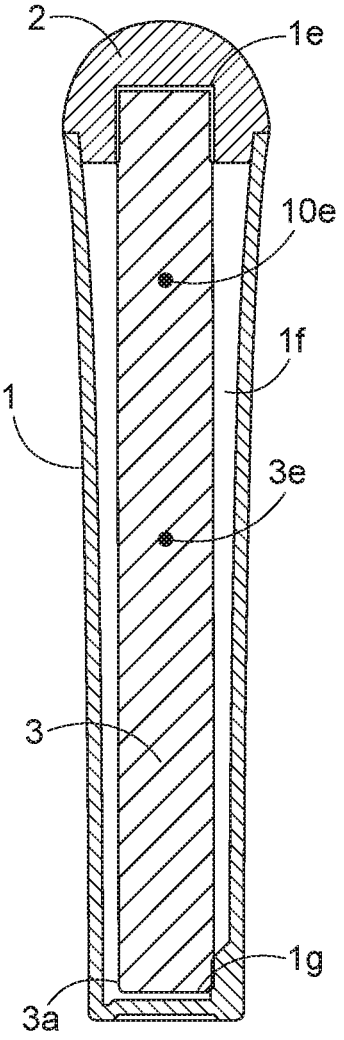
FIG. 2 depicts a cross section of the tool (10) of FIG. 1.

Referring to FIGS. 1 and 2, a cooling tool (10) according to the present invention comprises a body (1) that supports an applicator head (2) and houses a heat absorbing core (3). The applicator head is thermally connected to the heat absorbing core. An optional spring (5) is provided between the applicator head and body. The construction of these elements is intended to facilitate substantial heat transfer from the skin to the core of the tool in a short amount of time.

The Body

Figure 3A:
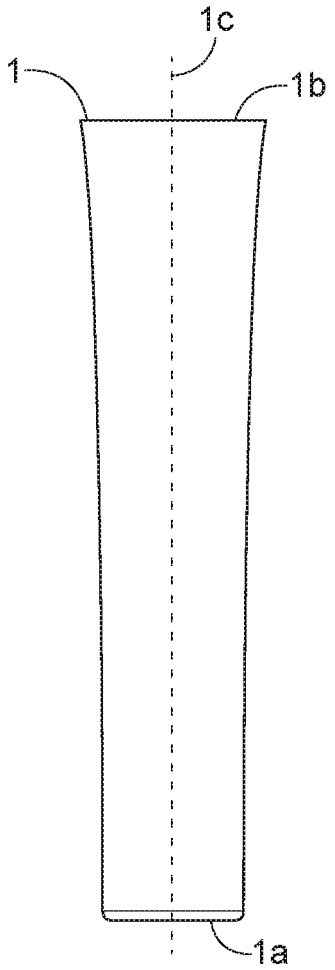
FIGS. 3A, 3B and 3C depict the body (1) of the cooling tool (10).
Figure 3B:
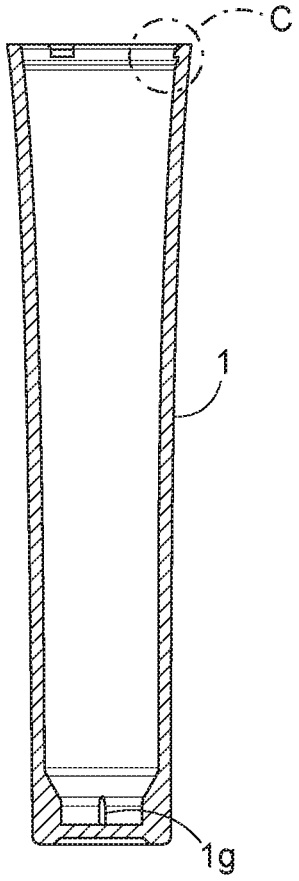
Figure 3C:
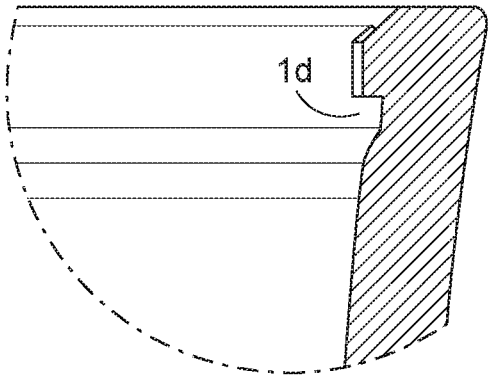

Referring to FIGS. 3A, 3B and 3C, the body (1) is a hollow, elongated member that serves as a handle. The body has a proximal end (1*a*) (that may be opened or closed), an opened distal end (1*b*), and a central longitudinal axis (1*c*). The body is sized to be comfortably grasped in the hand of a user. For example, a body may typically be from 5 to 20 cm in length. The cross sectional shape of the body is preferably circular, but may be some other shape. The cross section will have largest dimension (a diameter, for example) of about 1 to 5 cm. The body supports the applicator head (2) and houses the heat absorbing core (3). To support the applicator head, the inner surface of the distal end (1*b*) of the body may be provided with a groove (1*d*; see detail section shown in FIG. 3C) that interacts with the applicator head as described below.

The body (1) is a relatively poor conductor of heat. This isolates the user's hand from the applicator head (2), so that the efficiency of the applicator head is not compromised by heat from the user's hand. Specifically, since the body is a poor conductor of heat, the heat that emanates from the hand of a user cannot easily pass through the body and into the heat absorbing core (3) or applicator head, which would decrease the efficiency of the tool by decreasing the heat transfer from the applicator head into the heat absorbing core. Also, as we will see, the body has minimal contact with the applicator head and the heat absorbing core, which further limits the movement of thermal energy. Preferably, the body is fashioned of plastic, such as varieties of polyethylene (PET, PETG, etc.), and not metal. Also, the body will have a low thermal conductivity, which we define as less than about 0.5 W/m-K, to prevent heat transfer from the user's hand. For aesthetic reasons, the body may be clear or opaque.

Applicator Head

Figure 4:
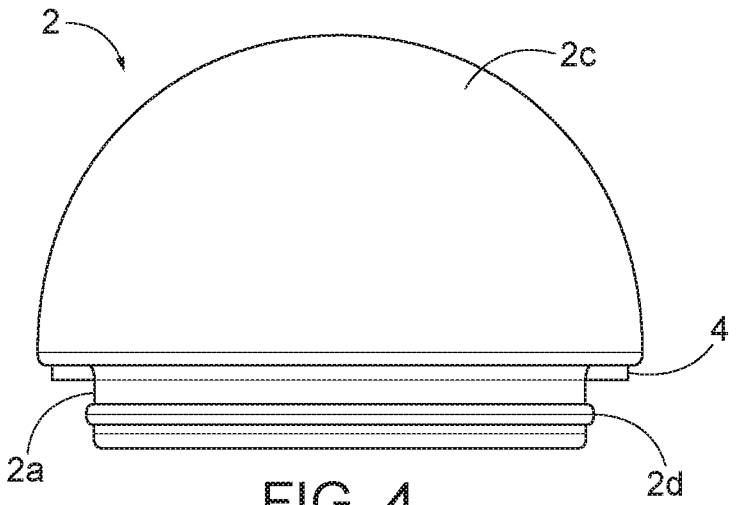
FIG. 4 depicts the applicator head (2).

Referring to FIG. 4, the applicator head (2) comprises a skin contact surface (2*c*). The skin contact surface is that part of the cooling tool (10) that contacts the skin of a user, to draw heat away from the user's skin. The applicator head is connected to the body (1) and the heat absorbing core (3). The applicator head that is retained in the opened distal end (1*b*) of the body and protrudes from the distal end so that it may contact the skin of a user. There are various useful means for achieving the connection to the body. For example, the base (2*a*) of the applicator head may be sized to fit into the opened distal end (1*b*) of the body, and retained there by a snap fitting, or by a screw threaded engagement, or by adhesive (preferably an adhesive that does not conduct heat very well). The snap fitting may comprise an annular ring (2*d*) on the base of the applicator head that fits snuggly into the groove (1*d*) of the body. Since the body (1) is plastic, the opening at the distal end (1*b*) of the body will flex to enlarge slightly, and allow the annular ring of the applicator head to slide down into the groove. A slot (2*b*) is located in the applicator head, sized to receive a distal end (3*b*) of the heat absorbing core (3) (see FIG. 5). Optionally, a gasket (4) may be situated in between the applicator head and body to prevent water or other contaminants from getting into the body (see FIG. 4).

Figure 5:
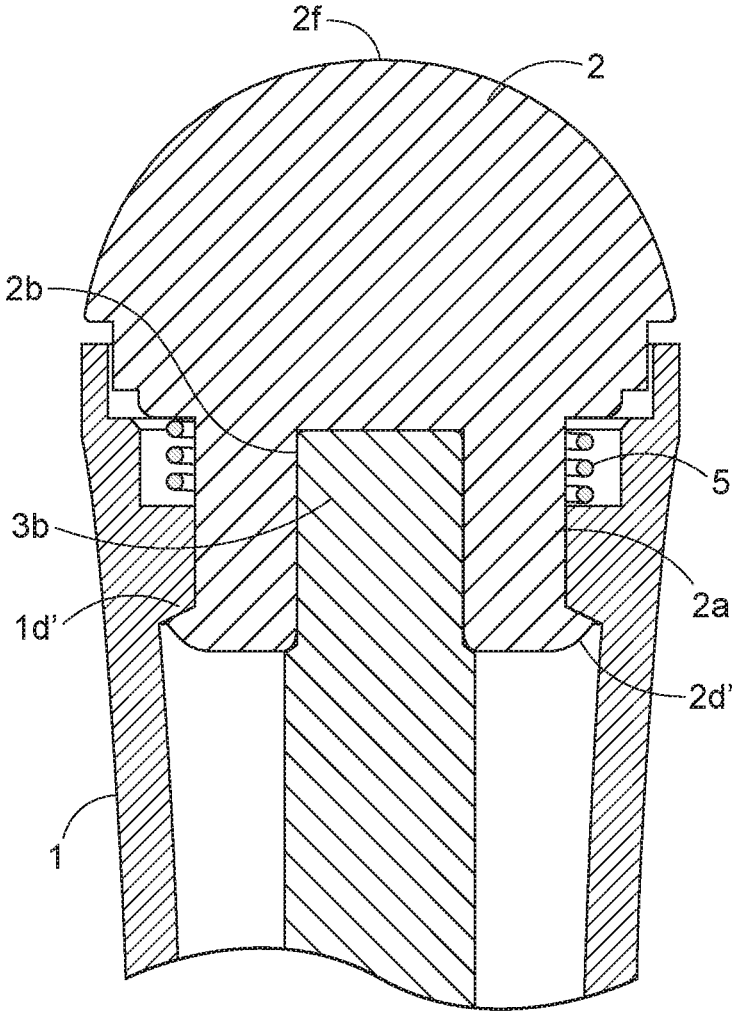
FIG. 5 depicts the connection of the applicator head (2) to the body (1).

In some embodiments, the connection between the applicator head (2) and body (1) is rigid and permanent from a consumer-use perspective. This prevents a lose connection between the applicator head and body, which would lead to an inconsistent experience for the consumer. Optionally, however, a resilient component, such as a spring (5; see FIG. 5), may be disposed between the body (1) and the applicator head (2). In this embodiment, the applicator head, with the heat absorbing core attached (3), would be capable of moving between a first position and a second position relative to the body, while still remaining connected to the body. For example, in first position, an annular ring (2*d*') on the base (2*a*) of the applicator head contacts a stop (1*d*') located on the inner surface of the body (as shown in FIG. 5). When a user presses the applicator head against her skin, the applicator head moves toward a second position. In second position, the annular ring (2*d*') is below the stop (1*d*'). When the user removes the applicator head from her skin, the spring expands to return the applicator head to first position. The primary benefit of the spring is to provide a consistent application pressure between the skin and applicator head, as a user moves the tool around her face. By maintaining a consistent application pressure, the heat transfer rate from the skin to the applicator head has minimal variation, so that the tool gives a more consistent performance. The use of a sprung applicator head also provides a softer tactile experience for the user, which is more comfortable and more elegant.

The applicator head (2) must have a relatively high thermal capacity and be a good conductor of heat. This will allow for substantial heat transfer away from the skin, and into the heat absorbing core. The thermal conductivity of the applicator head must be large, which we define as greater than about 10 W/m-K. In general, the most efficient applicator head will be of unitary, of single construction. The preferred material for the applicator head is metal, which, through polishing, can be provided with a specified surface finish. In general, a smooth surface is not only more comfortable for the user, but provides the most physical contact between the skin and applicator head. In contrast, a rougher surface would trap air between the skin and applicator, which would decrease heat transfer, since air is a relative poor conductor of heat. However, there are other considerations, so that the temperature at which a user intends to use the tool should be considered when designing the surface finish of the applicator head. For example, at temperatures below the freezing point of water (such as might be found in a consumer freezer), a rougher surface texture is preferred to prevent the metal applicator head from sticking to the facial tissue. In this case, a preferred surface roughness is between 0.4 μm and 70 μm. While the rougher surface will trap air between the skin and applicator causing a decrease in heat transfer, the very cold temperature of the applicator head will more than make up for that. On the other hand, for warmer temperatures such as 5° C. (as might be found in a consumer refrigerator) up to room temperature, a finer surface texture is preferred to maximize the heat transfer rate, and to provide the user with a comfortable experience. In this case, the preferred surface roughness is between 0.012 μm and −2.0 μm. Suitable materials for the applicator head include aluminum, brass, copper, cast iron, gold, silver, and steel. A preferred metal is stainless steel, which can accept a high degree of polishing and will resist corrosion.

Figure 6:
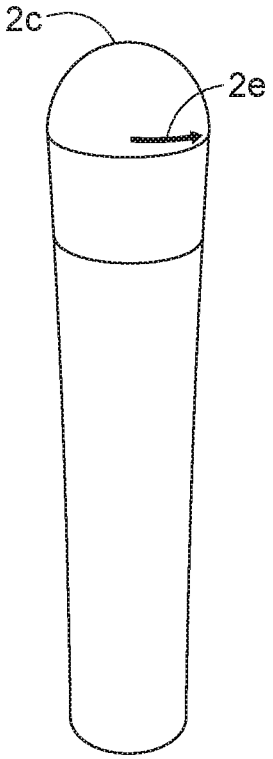
FIGS. 6, 7 and 8 depict various embodiments of the applicator head (2).
Figure 7:
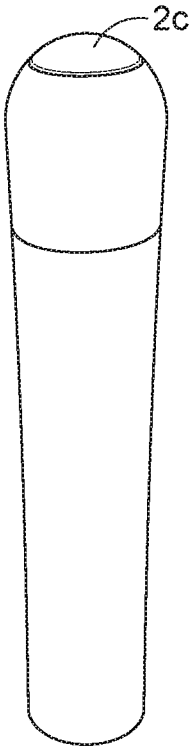
Figure 8:
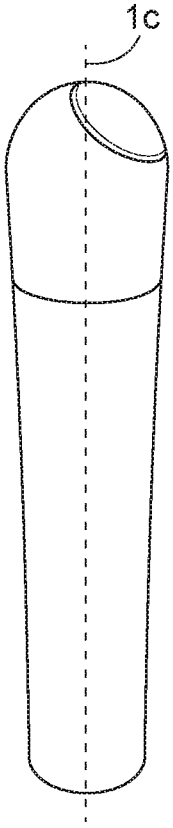

The shape of the skin contact surface (2*c*) will also determine how efficiently heat is transferred away from the skin. In general, the more contact between the skin and the skin contact surface, the more quickly heat will be drawn away from the skin, and the temperature of the skin will be lowered. However, consumer comfort is also a factor, and the ability to easily glide the applicator head over the skin. Thus, applicator heads with sharp angles and straight edges should be avoided, as these may scratch the skin, or otherwise be uncomfortable. Therefore, preferred skin contact surfaces are preferably shaped as spherical domes ranging from hemi-spherical (FIG. 6) to something less than hemi-spherical (FIGS. 7 and 8). They have no sharp angles or straight edges. Note FIG. 8, where the applicator head may be positioned off center, that is, not symmetric with respect to the central longitudinal axis (1*c*) of the body (1). When the applicator is less than hemi-spherical, this off center positioning provides the user with a more comfortable angle at which to hold the tool.

The domed applicator head (2) is characterized by a radius (2*e*) and an apex (2*f*). In general, the radius of the skin contact surface (2*c*) of the applicator head typically ranges from 0.5 cm to 30 cm. Ideally, an applicator head with a larger radius will be used on the forehead and cheekbones, and an applicator head with a smaller radius will be used around the eyes and nose. For example, in tests, a radius of between about 1.0 cm and 1.5 cm proved useful for under eye treatment, while between 1.1 cm and 1.2 cm proved to be ideal for under eye treatment; small enough to work the tight areas near the canthus of the eye, but large enough to allow coverage of the area in just a few strokes. Even smaller radii proved useful for treating crow's feet where sustained targeted cooling is beneficial. A radius between about 1.0 cm and 2.0 cm was very useful for a full-face application, while a radius greater than about 2.0 cm and up to 30 cm can be used to serve broad, flat areas of the body, like the arms, legs, bottoms of the feet, etc.

Heat Absorbing Core

The heat absorbing core (3) is a metallic mass having a distal end (3*b*) and a proximal end (3*a*). The distal end of the heat absorbing core is inserted into the slot (2*b*) of the applicator head (2), while the proximal end of the heat absorbing core extends down into the hollow body (1). The heat absorbing core is a heat sink, designed to efficiently accept the heat that is coming through the applicator head from that portion of a user's skin that is being treated, but not so efficiently from the hand of a user coming through the body. The heat absorbing core and the applicator head are both metallic. They may be made of the same metal (stainless steel, for example) or different metals. Either way, the heat absorbing core should have a higher thermal capacity than the applicator head, so that heat is continuously drawn away from the user's skin during the intended use of the tool. Thermal capacities of the applicator head and heat absorbing core are determined by the respective thermal capacitances of each member and the mass of each member. In general, the mass of the heat absorbing core is much larger than that of the applicator head, but it is also preferable if the thermal capacitance of the heat absorbing core is equal to or greater than the thermal capacitance of the applicator head. Most preferably, the thermal capacitance of the heat absorbing core is significantly greater than the thermal capacitance of the applicator head. By having both a greater mass and a greater thermal capacitance, the heat absorbing core will efficiently draw heat form the applicator head. In general, the heat absorbing core has a relatively high thermal capacitance; at least 25 J/K and preferably greater. Preferably, the core extends almost the entire length of the interior of the body, which allows the core to be as large as possible, and therefore, a better heat sink. Preferably, the mass of the core is from about 40 g to about 150 g, more preferably, from 50 g to 125 g, and most preferably about 60 g to 100 g.

We can also speak of the thermal capacity of the combined applicator head and heat absorbing core. As a unit, a combined thermal capacity of about 25 to 35 J/K has proven to be very effective when the use time is 4 to 5 minutes for a tool charged in a household refrigerator.

In preferred embodiments, the distance from the applicator head to the center of mass (3*e*) of the heat absorbing core is as large as possible. This allows the absorbed heat to travel as far away from the applicator head as possible. Therefore, it is preferable if the distance from the applicator head to the center of mass (3*e*) of the heat absorbing core is at least one-third the of the length of the body (1).

The heat absorbing core (3) may be a cylindrical mass, the distal end (3*b*) of which is permanently inserted into the slot (2*b*) in the applicator head (2). The core may be retained in the slot of the applicator head by a friction fit, snap fit or threaded engagement. Alternatively, a heat conductive adhesive (1*e*) may be disposed between the applicator head and the heat absorbing core. When a heat conductive adhesive is used, it should have a thermal conductivity of at least 1 W/m-K, to ensure adequate overall heat transfer rate. Alternatively, the heat absorbing core and the applicator head may be fashioned as a unitary structure. Alternatively, in some embodiments to be discussed below, the heat absorbing core is moveable with respect to the applicator head, the distal end (3*b*) of the heat absorbing core being able to slide proximally and distally within the slot (2*b*) of the applicator head.

It is preferable if the heat absorbing core (3) has minimal contact with the body (1) to limit the amount of heat that is transferred from a user's hand, through the body, and into the core. Therefore, although the heat absorbing core extends the length of the interior of the body, an air gap (1*f*) separates the two. If it is necessary to add additional support for the heat absorbing core, then there may be minimal contact between the core and the body. Minimal contact means that less than 1% of the surface of the heat absorbing core is in contact with the body. For example, FIGS. 2 and 3 show a spline or rib (1*g*) located near the proximal end (1*a*) of the body (1), to support the weight of the heat absorbing core. However, in this case, the amount of contact between the body and heat absorbing core is minimal (i.e. less than 1% of the heat absorbing core is in contact with the body) and has no detrimental effect on the use of the tool to cool the skin. In some embodiments to be discussed below, the distal end (3*b*) of the heat absorbing core is supported in the slot (2*b*) of the applicator head (2) by a spring (12).

The cooling tool (10) has an overall length that is measured from the apex (2*f*) of the skin contact surface (2*c*) of the applicator head (2) to the proximal end (1*a*) of the body (1). The cooling tool is significantly heavier than most cosmetic and personal care implements. Therefore, for optimal control by a user, the center of mass (10*e*) of the cooling tool (10) should be located a distance from the apex of the skin contact surface of the applicator head that is between 25% and 75% of the length of the tool, preferably between 25% and 50% of the length of the tool. For example, if the cooling tool is 10 cm long, then the center of mass will be between 2.5 cm and 7.5 cm from the apex of the skin contact surface, or more preferably, between 2.5 cm and 5.0 cm from the skin contact surface of the applicator head. Or, if the tool is 5 cm long, then the center of mass of the tool will be between 1.25 cm and 3.75 cm from the skin contact surface (2*c*) of the applicator head, or more preferably, between 1.25 cm and 2.5 cm from the apex of the skin contact surface of the applicator head.

Use

Generally, a personal care tool (10) for cooling and treating skin as described herein, should be chilled before use. Preferably, the tool will be placed in any environment whose ambient temperature is lower than about 15° C., and remain there long enough to equilibrate. More preferably, the ambient temperature is about 5° C.-10° C. Such temperatures are common in household refrigerators. A cooling tool for cooling and treating skin as described herein can also be stored in an environment having an ambient temperature below 0° C., but when the applicator head is that cold, it may be uncomfortable for some users.

Figure 10:
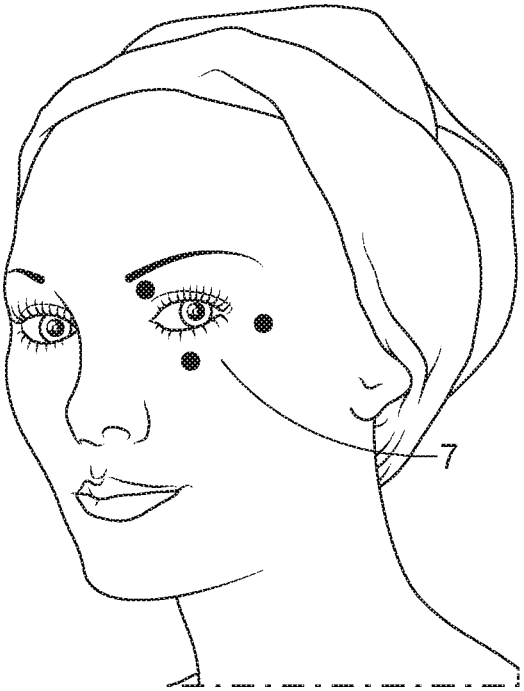
FIGS. 10, 11 and 12 show some common areas of the face where the cooling tool (10) may be applied for an expected benefit.
Figure 11:
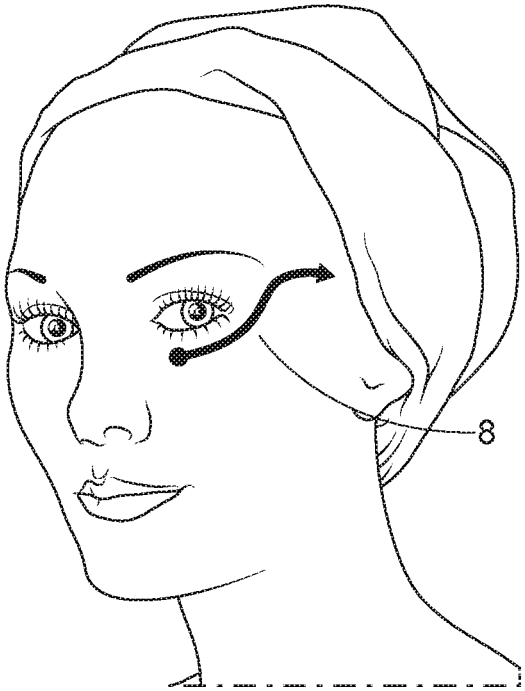
Figure 12:
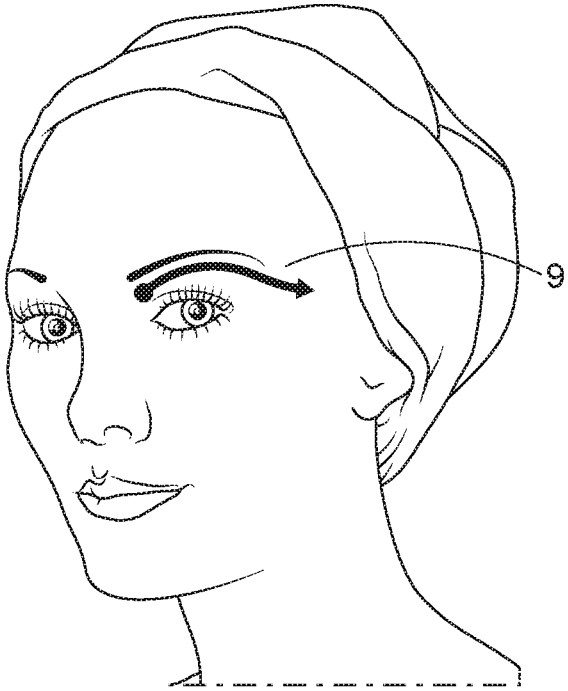

Once the applicator head (2) is cooled, a user grasps the body (1) of the tool (10) and contacts the applicator head to the surface of her skin where treatment is desired. This may mean that the applicator head is drawn across the surface of the skin (as depicted in FIGS. 11 and 12) or held on a single spot for a period of time (as depicted in FIG. 10) or a combination of the two. The cold applicator head removes heat from the skin surface, which pass through the applicator head, and into the heat absorbing core. The transfer of heat is fast, and the cooling effect can be maintained for a significant period of time, such as, at least 5 minutes, for example. During this time, the tool may be used to treat areas of the face, such as under-eye, forehead, cheeks, and jowls to improve the appearance of the skin by reducing inflammation, puffiness, blood pooling and other undesirable skin imperfections. The tool may also be used to massage other parts of the body to sooth and relax the muscles, and reduce swelling in cutaneous tissues.

In development of a personal care cooling tool, as claimed herein, the inventors repeatedly observed that the tool is effective to treat the skin by reducing skin temperature, and that the effect remains for a substantial period of time (more than 5 minutes) after the treatment has ended. The cooling effect not only lasts longer than the cooling effect of a control group, but the magnitude of the effect is also greater than the effect of the control group. The observed effect was definitely attributable to the use of the cooling tool as claimed herein.

Optional Charging Base

Figure 9:
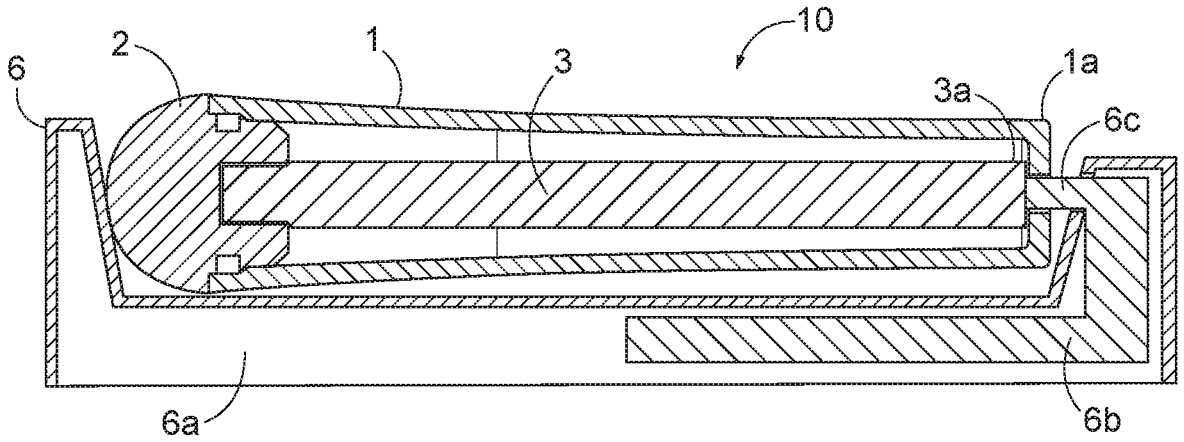
FIG. 9 depicts a cooling tool (10) reposed in a charging base (6).

As described above, prior to use, the personal care cooling tool is placed in a cold environment, and allowed to equilibrate to the ambient temperature. The length of time for this to happen can be shortened by the use of a charging base, as now described. Referring to FIG. 9, the charging base (6)

comprises housing (6*a*) and a heat sink (6*b*). In use, the charging base will remain in a cold environment, like a refrigerator, so that it is always ready for use. The principle, here, is similar to how the heat absorbing core (3) draws heat away from the applicator head (2). Only now, the heat sink (6*b*) of the charging base will draw heat away from the heat absorbing core (3) of the cooling tool (10), which allows the heat absorbing core and the applicator head to cool more rapidly.

In the embodiment of FIG. 9, the charging base (6) comprises a plastic housing (6*a*) that houses the heat sink (6*b*), and into which the personal care cooling tool (10) can be reposed. The heat sink is a mass of metal, at least a portion (6*c*) of which protrudes from the plastic housing (6*a*) so that it can contact the proximal end (3*a*) of the heat absorbing core (3) of the cooling tool. In this embodiment, the proximal end (1*a*) of the body (1) of the cooling tool is opened, so that when the cooling tool is reposed in the charging base, then the protruding portion (6*c*) of the heat sink passes into the proximal end of the body (1) and makes physical contact with the heat absorbing core. It is the physical contact between the heat sink (6*b*) and the heat absorbing core (3) that forces the applicator head to cool more rapidly than if the tool is placed in a refrigerator without the charging base. Preferably, the heat sink has a thermal capacity that is at least as large as the thermal capacity of the heat absorbing core, although this is not strictly necessary to see a benefit. Therefore, it is preferable if the heat sink (6*b*) of the charging base has a thermal capacitance of at least 25 J/K, and preferably greater, and a mass of 50 g, and preferably greater. Specifically, it is more preferable if the heat sink (6*b*) has a thermal capacity that is at least twice as large as the thermal capacity of the heat absorbing core.

When a consumer wants to use the cooling tool, she opens her refrigerator, removes the tool from the charging base, leaving the charging base in the refrigerator. After use, the tool is returned to the charging base, in the refrigerator.

Optional Variable Cooling Rate Control

Figure 13A:
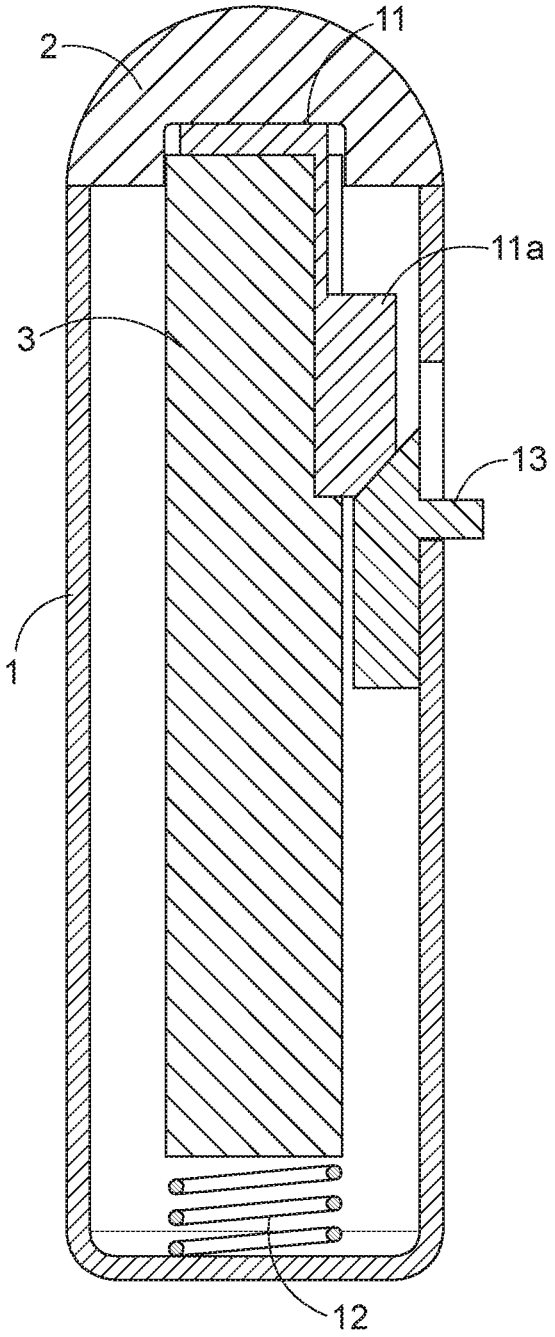
FIGS. 13A and 13B show an embodiment of the invention with a control for adjusting the rate at which the cooling tool (10) cools the skin.
Figure 13B:
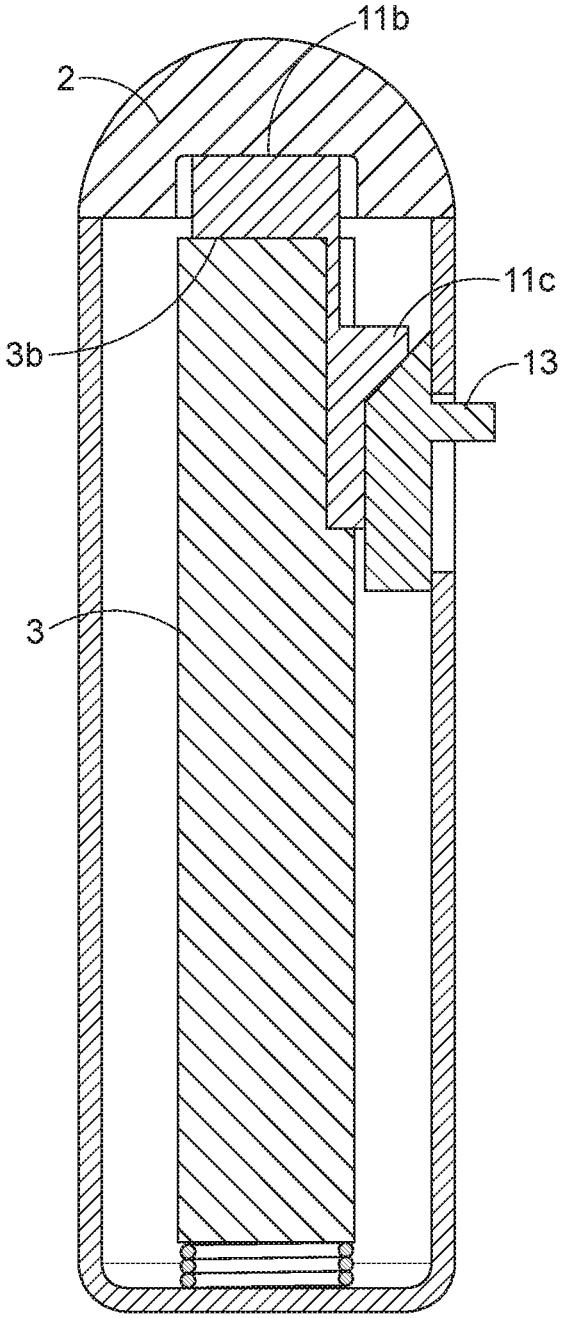

Optionally, some embodiments of the present invention may comprise a control for adjusting the rate at which the cooling tool cools the skin. The control allows a user to move the heat absorbing core with respect to the applicator head, thereby adjusting the rate of heat transfer from the applicator head to the heat absorbing core. The concept is illustrated in FIGS. 13A and 13B. A first portion (11*b*) of a flexible enclosure (11) is disposed in the slot (2*b*) between the applicator head (2) and the distal end (3*b*) of the heat absorbing core (3). A second portion (11*c*) of the flexible enclosure is disposed between the heat absorbing core and the body (1). A fluid (11*a*) is disposed in the flexible enclosure (11). A spring (12) is disposed between the proximal end (3*a*) of the heat absorbing core and the proximal end (1*a*) of the body, such that the heat absorbing core is able to move longitudinally as more or less fluid is moved into or out of the slot (2*b*) of the applicator head.

As shown, a switch (13) passes through the wall of the body (1), and is able to slide longitudinally between a first position and a second position. When moved into the first position, the switch compresses the flexible enclosure (11), and when moved toward second position, the switch allows the flexible enclosure to relax. As the flexible enclosure is compressed by the switch, some of the fluid (11*a*) moves into the first portion (11*b*) of a flexible enclosure, which forces the heat absorbing core (3) to move proximally, compressing the spring (12). As a result, less of the distal end (3*b*) of the heat absorbing core is in the slot (2*b*) of the applicator head, and the rate of heat transfer from the applicator head to the heat absorbing core is decreased. Thus, the rate of cooling is decreased. This is shown in FIG. 13B. Likewise, as the switch moves from first position to second position, the spring (12) expands forcing the heat absorbing core to move distally (that is, further into the slot of the applicator head) and moving some of the fluid into the second portion (11*c*) of the flexible enclosure. As a result, the heat absorbing core more efficiently removes heat from the applicator head. Thus, the rate of cooling is increased. This is shown in FIG. 13A.

What is claimed is:

1. A handheld cooling tool (10) for drawing thermal energy away from a skin surface, the cooling tool comprising:

a hollow, elongated body (1) that has a thermal conductivity less than 0.5 W/m-K, the elongated body having:
- a proximal end (1*a*),
- an opened distal end (1*b*); and
- a central longitudinal axis (1*c*);

a metallic applicator head (2) that is retained in and protrudes from the opened distal end (1*b*) of the body, the applicator head is a single piece, the applicator head having:
- a skin contact surface (2*c*) that has a roughness between 0.4 μm and 70 μm;
- a slot (2*b*), and
- a thermal conductivity greater than 10 W/m-K; and a metallic heat absorbing core (3) that extends from the slot (2*b*) of the applicator head (2), down into the hollow body (1), the heat absorbing core having:
- a thermal capacitance of at least 25 J/K; and
- a mass of 50 g to 150 g; and the heat absorbing core (3) contacts the body (1), wherein an air gap separates the heat absorbing core (3) and the body (1), such that less than 1% of the surface of the heat absorbing core (3) is in contact with the body.

2. The handheld cooling tool (10) of claim 1 further comprising a heat conductive adhesive (1*e*) disposed between the applicator head (2) and the heat absorbing core (3), wherein the heat conductive adhesive has a thermal conductivity of at least 1 W/m-K.

3. The handheld cooling tool (10) of claim 1 wherein the heat absorbing core (3) and the applicator head (2) are fashioned as a unitary structure.

4. The handheld cooling tool (10) of claim 1 further comprising a gasket (4) situated in between the applicator head (2) and body (1).

5. The handheld cooling tool (10) of claim 1 further comprising a spring (5) disposed between the body (1) and the applicator head (2), such that the applicator head is able to move between a first position and a second position relative to the body, while still remaining connected to the body.

6. The handheld cooling tool (10) of claim 1 wherein the roughness of the skin contact surface (2*c*) is between 0.012 μm and −2.0 μm.

7. The handheld cooling tool (10) of claim 1 wherein the skin contact surface (2*c*) is shaped as a spherical dome ranging from hemi-spherical to something less than hemi-spherical, and a radius of the skin contact surface ranges from 0.5 cm to 30 cm.

8. The handheld cooling tool (10) of claim 7 wherein the radius of the skin contact surface ranges from 2.0 cm to 30 cm.

9. The handheld cooling tool (10) of claim 7 wherein the radius of the skin contact surface ranges from 1.0 cm and 2.0 cm.

10. The handheld cooling tool (10) of claim 7 wherein a position of the applicator head (2) is not symmetric with respect to the central longitudinal axis (1*c*) of the body (1).

11. The handheld cooling tool (10) of claim 1 wherein the center of mass (10*e*) of the cooling tool is located a distance from an apex (2*f*) of the skin contact surface (2*c*) of the applicator head (2) that is between 25% and 50% of the length of the cooling tool.

12. The handheld cooling tool (10) of claim 1 wherein the thermal capacity of the combined applicator head (2) and heat absorbing core (3) is 25 J/K to 35 J/K.

13. In combination, a handheld cooling tool (10) according to claim 1 and a charging base (6) for the handheld cooling tool, wherein the proximal end (1*a*) of the body (1) of the cooling tool is opened, and wherein the charging base comprises:

a housing (6*a*) that houses a metallic heat sink (6*b*);

wherein, at least a portion (6*c*) of the metallic heat sink (6*b*) protrudes from the housing (6*a*) and passes into the proximal end (1*a*) of the body (1), to contact the heat absorbing core when the cooling tool is reposed in the charging base (6); and wherein the heat sink has a thermal capacity that is at least as large as the thermal capacity of the heat absorbing core (3) of the cooling tool (10).

14. The handheld cooling tool (10) of claim 1 further comprising:

a spring (12) disposed between a proximal end (3*a*) of the heat absorbing core (3) and the proximal end (1*a*) of the body (1);

a first portion (11*b*) of a flexible enclosure (11) disposed in the slot (2*b*), between the applicator head (2) and a distal end (3*b*) of the heat absorbing core (3);

a second portion (11*c*) of the flexible enclosure (11) disposed between the heat absorbing core (3) and the body (1);

a fluid (11*a*) disposed in the flexible enclosure (11);

a switch (13) that passes through a wall of the body (1), such that in a first position the switch compress the flexible enclosure (11) and in a second position the flexible enclosure is allowed to relax;

wherein, when the flexible enclosure (11) is compressed by the switch (13), some of the fluid (11*a*) moves into the first portion (11*b*) of a flexible enclosure, which forces the heat absorbing core to move proximally, compressing the spring (12); and as the switch (13) moves from first position to second position, the spring (12) expands forcing the heat absorbing core to move distally, and moving some of the fluid (11*a*) into the second portion (11*c*) of the flexible enclosure (11).

* * * * *